US009562438B2

(12) United States Patent
Lattanzio et al.

(10) Patent No.: US 9,562,438 B2
(45) Date of Patent: Feb. 7, 2017

(54) UNDER-ROOT SPACER FOR GAS TURBINE ENGINE FAN BLADE

(71) Applicant: United Technologies Corporation, Hartford, CT (US)

(72) Inventors: Santiago Lattanzio, Manchester, CT (US); Michael A. Weisse, Tolland, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 466 days.

(21) Appl. No.: 14/161,760

(22) Filed: Jan. 23, 2014

(65) Prior Publication Data

US 2014/0219807 A1 Aug. 7, 2014

Related U.S. Application Data

(60) Provisional application No. 61/761,996, filed on Feb. 7, 2013.

(51) Int. Cl.
*F01D 5/30* (2006.01)

(52) U.S. Cl.
CPC ..... *F01D 5/3007* (2013.01); *F05D 2220/36* (2013.01)

(58) Field of Classification Search
CPC ..... F01D 5/3007; F05D 2220/36
USPC ..... 416/220 R, 221, 248, 500
See application file for complete search history.

(56) References Cited

U.S. PATENT DOCUMENTS

| | | | | |
|---|---|---|---|---|
| 3,936,234 | A | 2/1976 | Tucker et al. | |
| 4,208,170 | A | 6/1980 | Tucker et al. | |
| 5,123,813 | A | 6/1992 | Przytulski et al. | |
| 5,362,302 | A * | 11/1994 | Jensen | A61H 1/0222 5/612 |
| 5,443,366 | A | 8/1995 | Knott et al. | |
| 5,501,575 | A | 3/1996 | Eldredge et al. | |
| 6,398,499 | B1 | 6/2002 | Simonetti et al. | |
| 6,431,835 | B1 | 8/2002 | Kolodziej et al. | |
| 6,481,971 | B1 | 11/2002 | Forrester | |
| 6,694,723 | B2 | 2/2004 | Ward | |
| 7,334,996 | B2 | 2/2008 | Corbin et al. | |
| 2004/0076523 | A1 * | 4/2004 | Sinha | F01D 5/3007 416/219 R |
| 2011/0305576 | A1 | 12/2011 | Ward et al. | |
| 2013/0156591 | A1 * | 6/2013 | Alexander | F01D 5/3092 416/221 |
| 2016/0024946 | A1 * | 1/2016 | Weisse | F01D 25/16 416/219 R |

* cited by examiner

*Primary Examiner* — Hoang Nguyen
(74) *Attorney, Agent, or Firm* — Carlson, Gaskey & Olds, P.C.

(57) ABSTRACT

A gas turbine engine rotor includes a hub having a slot. A blade includes a root received in the slot. An under-root area is provided between the root and the fan hub in the slot. A spacer includes first and second portions that cooperate with one another to provide an adjustment feature with discrete height settings. The adjustment feature provides different radial heights of the spacer. The spacer is arranged in the under-root area beneath the root.

15 Claims, 3 Drawing Sheets

UNDER-ROOT SPACER FOR GAS TURBINE ENGINE FAN BLADE

CROSS REFERENCE TO RELATED APPLICATION

This application claims priority to U.S. Provisional Application No. 61/761,996 which was filed on Feb. 7, 2013.

BACKGROUND

This disclosure relates to a gas turbine engine. More particularly, the disclosure relates to an under-root spacer for a space within a fan hub slot and for applying a load to the root.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

A fan section is driven by the turbine section and includes circumferentially arranged fan blades mounted on a fan hub. Roots of the fan blades are supported within correspondingly shaped slots in the fan hub. A space is provided beneath the root and the bottom of the slot, and the size of this space varies at each circumferential location due to manufacturing tolerances.

Fan blade roots tend to wear from friction during windmill conditions. One type of under-root spacer has been used which is inserted into the space by elastically compressing using a bolted connection. However, this technique may result in load variation between different fan blade circumferential locations, which is undesirable. Consistent loads at each circumferential location are desired to prevent movement within the slot and root wear.

SUMMARY

In one exemplary embodiment, a gas turbine engine rotor includes a hub having a slot. A blade includes a root received in the slot. An under-root area is provided between the root and the fan hub in the slot. A spacer includes first and second portions that cooperate with one another to provide an adjustment feature with discrete height settings. The adjustment feature provides different radial heights of the spacer. The spacer is arranged in the under-root area beneath the root.

In a further embodiment of any of the above, the first and second portions are discrete from one another.

In a further embodiment of any of the above, the second portion includes opposing first and second ends, and the first end is pivotally secured to the first portion by a pin.

In a further embodiment of any of the above, the adjustment feature is provided by the second end, and the second end cooperates with a feature on the first portion.

In a further embodiment of any of the above, the adjustment feature on the first portion is provided by multiple tabs spaced apart from one another.

In a further embodiment of any of the above, the spacer is constructed from a polymer material.

In a further embodiment of any of the above, the second portion is spaced from the first portion a desired distance to provide a desired height setting.

In a further embodiment of any of the above, the root has an end surface, and the space engages the rotor and the end surface and applies a desired load on the root.

In a further embodiment of any of the above, the first and second portions are integral with one another.

In a further embodiment of any of the above, the rotor includes a fan section, the hub is a fan hub, and the blade is a fan blade.

In another exemplary embodiment, a spacer for a gas turbine engine rotor includes first and second portions that cooperate with one another to provide an adjustment feature. The adjustment feature has discrete height settings that provide different radial heights of the spacer. The spacer is arranged in the under-root area beneath the root.

In a further embodiment of any of the above, the first and second portions are discrete from one another.

In a further embodiment of any of the above, the second portion includes opposing first and second ends, and the first end is pivotally secured to the first portion by a pin.

In a further embodiment of any of the above, the first and second portions are integral with one another.

In a further embodiment of any of the above, the adjustment feature is provided by the second end, and the second end cooperates with a feature on the first portion.

In a further embodiment of any of the above, the adjustment feature on the first portion is provided by multiple tabs spaced apart from one another.

In a further embodiment of any of the above, the spacer is constructed from a polymer material.

In a further embodiment of any of the above, the second portion is spaced from the first portion a desired distance to provide a desired height setting.

BRIEF DESCRIPTION OF THE DRAWINGS

The disclosure can be further understood by reference to the following detailed description when considered in connection with the accompanying drawings wherein.

DETAILED DESCRIPTION

Figure 1:
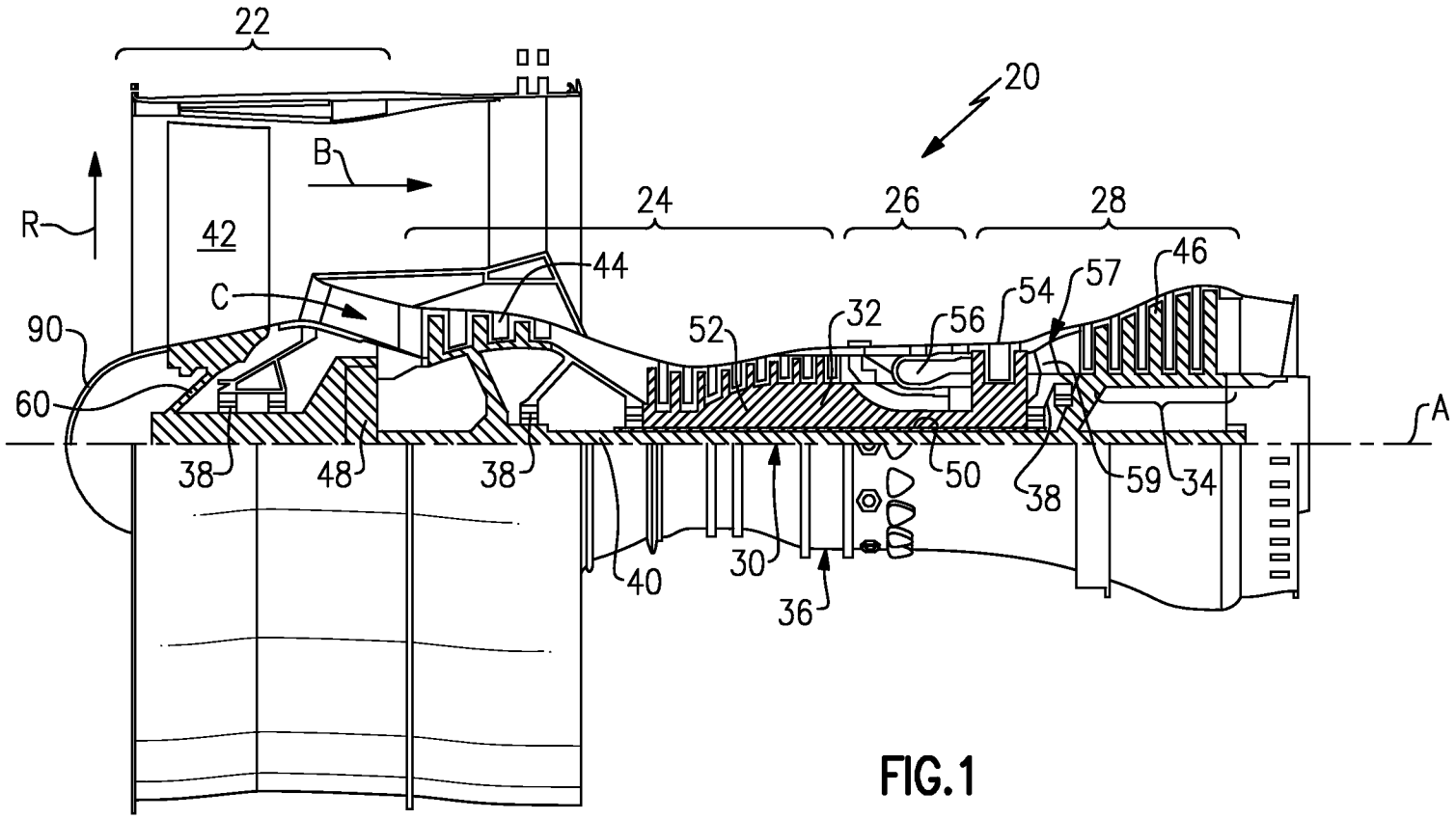
FIG. 1 schematically illustrates a gas turbine engine embodiment.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFCT')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed", as disclosed herein according to one non-limiting embodiment, is less than about 1150 ft/second.

Figure 2:
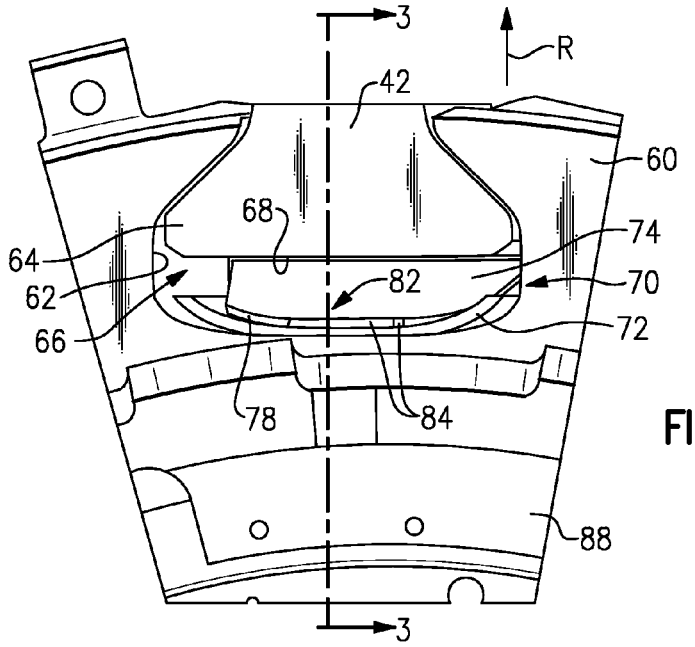
FIG. 2 is an end view of a portion of the fan section indicating an under-root area of a fan blade within a fan hub.

Referring to FIG. 2, the fan blade 42 is shown received in a slot 62 of a fan hub 60. A nose cone 90 (shown in FIG. 1) is secured to the hub 60 at an aft end flange 88 of the fan hub 60.

As is known, multiple fan blades are arranged circumferentially about the fan hub in the fan section 22. In particular, each fan blade 42 includes a root 64 providing an under-root gap 66 beneath an end surface 68 of the root 64 within the slot 62.

It is desirable to design the root 64 and the slot 62 with tight tolerances between the root 64 and fan hub 60 to prevent undesired motion within the slot 62, which causes wear. However, manufacturing tolerances vary and result in looser than desired clearances at some fan blade locations. This may be particularly problematic with especially large fan blades, which are used on geared gas turbine engines. To address tolerance variations, an adjustable spacer 70 is inserted into the slot 62 beneath the end surface 68 and the fan hub 60 to fill the gap 66 in the radial direction R.

Figure 3:
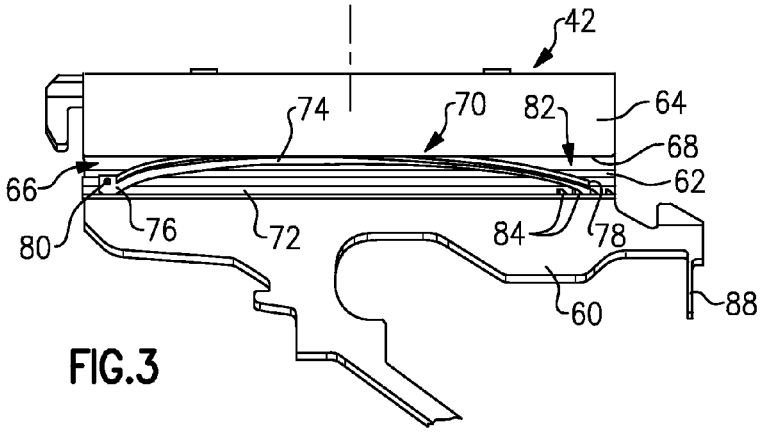
FIG. 3 is a cross-sectional view through the fan taken along line 3-3 of FIG. 2.
Figure 4:
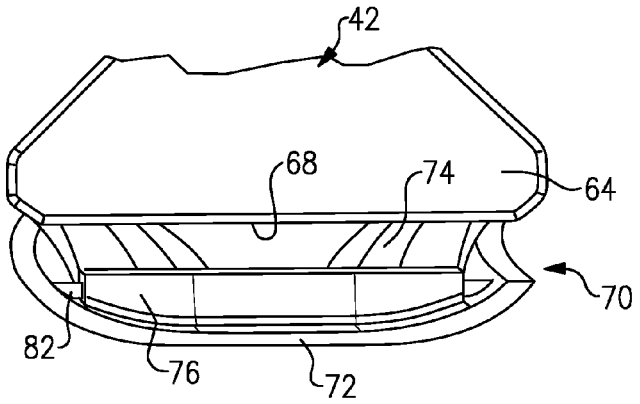
FIG. 4 is an aft end view of a fan blade root and spacer.
Figure 5A:
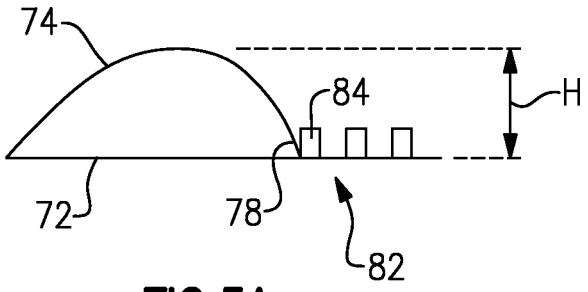
FIGS. 5A-5C are schematic views of the spacer in first, second and third adjustment positions, respectively.
Figure 5B:
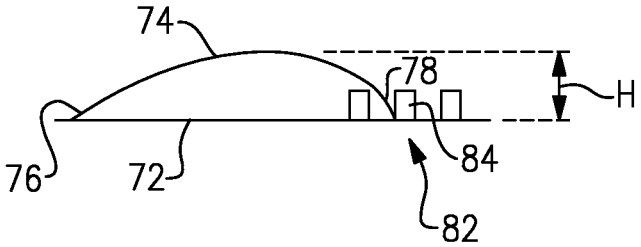
Figure 5C:
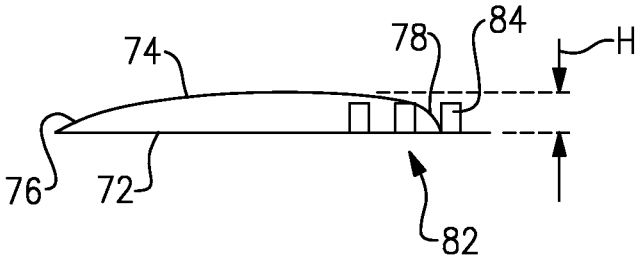

In the example illustrated in FIGS. 2-4, the spacer 70 includes first and second portions 72, 74 that cooperate with one another to provide a variable radial height with discrete height settings (indicated at H in FIGS. 5A-5C). The discrete height settings enable a more consistent load to be placed on the end surface 68 by the adjustable space for a wider range of tolerance stack ups than typical spacers.

In the example illustrated in FIGS. 2-4, the first and second portions 72, 74 are discrete from one another. As shown in FIGS. 2 and 4, the first portion 72 is contoured (curved in the lateral direction) to provide a complimentary shape to that of the slot 62, whereby the first portion 72 positions the spacer 70 laterally within the slot 62. The second portion 74 includes first and second opposing ends 76, 78. The first end 76 is pivotally attached to the first portion 72 by a pin 80 in the example.

In the example, the first and second portions 72, 74 are constructed from a plastic material, for example, a polyimide, such as VESPEL by DuPont. Although the first and second portions 72, 74 are illustrated as discrete components pinned to one another, the first and second portions 72, 74 may be molded as an integral, unitary structure, as schematically illustrated in FIGS. 5A-5C.

In the example shown, the second end 78 along with multiple tabs 84 provide an adjustment feature 82 in which the first and second portions 72, 74 may be adjusted relative to one another to provide the desired discrete, preset radial height for the spacer 70.

The first portion 72 is seated at the base of the slot 62 opposite the end surface 68. The second end 78 is placed in abutment with a desired tab 84 to achieve the desired radial height, which places the second portion 74 in close proximity to or engagement with the end surface 68. As a result, the spacer 70 accommodates clearances between the root 64 and the slot 62 to provide a tight fit between these components. Alternatively, a tab may be provided on the second portion and a series of apertures may be provided in the first portion to receive the tab in a desired position.

In operation, a size of the gap is determined for a given fan blade location. The second portion 74 is positioned relative to the first portion 72 to obtain a desired height setting for the given fan blade location. The desired height setting corresponds to a desired load that will be applied to the end surface 68 by the space 70. Smaller height settings than desired will result in too small of a load, while larger height settings than desired will result in too large of a load. Generally uniform loads at each circumferential fan blade location are desired.

Referring to FIGS. 5A-5C, various radial heights H are illustrated. In the example shown in FIG. 5A, the second end 78 is arranged in abutment with one of the tabs 84 to provide a relatively large radial height H for loose clearances. As shown in FIG. 5B, the second end 78 is placed in abutment of the tab 84 farther from the first end 76 to reduce the radial height H. In the example shown in FIG. 5C, the second end 78 is placed in abutment with the tab 84 even farther from the first end 76.

After the first and second portions 72, 74 have been positioned relative to one another to achieve the desired height setting, the spacer 70 is inserted into the gap 66. In the example, the first end 76 is slid into the slot 62 first.

The spacer can be used for various rotor applications, including rotors in fan sections, compressor sections and/or turbine sections.

In other words, in the example, the first portion is a relatively flat spacer base. The second portion is a flexible member having a distal end that is fixed at a distal part of the base and includes a proximate, free end. Plural tabs or ridges are adjacently located on the base, between the first location that is near the proximate end of the base and a second location that is closer to the center of the base. The proximate end of the flexible member is positionable against the tabs. As the proximate end of the flexible member is positioned against a tab that is closer to the center of the base, the flexible member bows outwardly as compared with other tab positions. As can be appreciated, a greater deflection in the flexible member provides a thicker spacer.

Although an example embodiment has been disclosed, a worker of ordinary skill in this art would recognize that certain modifications would come within the scope of the claims. For that reason, the following claims should be studied to determine their true scope and content.

What is claimed is:

1. A rotor for a gas turbine engine comprising:
a hub having a slot;
a blade including a root received in the slot, and a under-root area provided between the root and the fan hub in the slot; and
a spacer including first and second portions that cooperate with one another to provide an adjustment feature with discrete height settings providing different radial heights of the spacer, the spacer arranged in the under-root area beneath the root, wherein the second portion includes opposing first and second ends, the first end pivotally secured to the first portion by a pin.

2. The rotor according to claim 1, wherein the first and second portions are discrete from one another.

3. A rotor for a gas turbine engine comprising:
a hub having a slot;
a blade including a root received in the slot, and a under-root area provided between the root and the fan hub in the slot; and
a spacer including first and second portions that cooperate with one another to provide an adjustment feature with the discrete height settings providing different radial heights of the space, the space arranged in the under-root area beneath the root, wherein the adjustment feature is provided by an end cooperating with a feature on the first portion, wherein the adjustment feature on the first portion is provided by multiple tabs spaced apart from one another.

4. The rotor according to claim 1, wherein the spacer is constructed from a polymer material.

5. The rotor according to claim 1, wherein the second portion is spaced from the first portion a desired distance to provide a desired height setting.

6. The rotor according to claim 5, wherein the root has an end surface, and the spacer engages the rotor and the end surface and applies a desired load on the root.

7. The rotor according to claim 1, wherein the first and second portions are integral with one another.

8. The rotor according to claim 1, comprising a fan section, wherein the hub is a fan hub, and the blade is a fan blade.

9. A spacer for a gas turbine engine rotor under-root area comprising:
first and second portions that cooperate with one another to provide an adjustment feature with discrete height settings providing different radial heights of the spacer, the adjustment feature on the first portion is provided by multiple tabs spaced apart from one another, and the second portion includes a free end, the second portion configured to be deflected to position the free end with respect to a desired one of the multiple tabs which corresponds to one of the different radial heights.

10. The spacer according to claim 9, wherein the first and second portions are discrete from one another.

11. The spacer according to claim 10, where the second portion includes opposing first and second ends, the first end pivotally secured to the first portion by a pin, and the second end corresponds to the free end.

12. The spacer according to claim 9, wherein the first and second portions are integral with one another.

13. The spacer according to claim 9, wherein the spacer is constructed from a polymer material.

14. The spacer according to claim 9, wherein the second portion is spaced from the first portion a desired distance to provide a desired height setting for the spacer.

15. The spacer according to claim 9, wherein the first portion is curved in a lateral direction relative to longitudinal direction in which the first and second portions extend.

* * * * *